US005145349A

United States Patent [19]

McBurnett

[11] Patent Number: 5,145,349

[45] Date of Patent: Sep. 8, 1992

[54] GEAR PUMP WITH PRESSURE BALANCING STRUCTURE

[75] Inventor: James R. McBurnett, Greer, S.C.

[73] Assignee: Dana Corporation, Toledo, Ohio

[21] Appl. No.: 684,618

[22] Filed: Apr. 12, 1991

[51] Int. Cl.[5] ..... F04C 2/08

[52] U.S. Cl. ..... 418/206

[58] Field of Search ..... 418/206, 74, 131, 132

[56] References Cited

U.S. PATENT DOCUMENTS

| | | | |
|---|---|---|---|
| 2,624,287 | 1/1953 | Ilyin | 418/78 |
| 2,820,416 | 1/1958 | Compton | 418/78 |
| 2,871,794 | 2/1959 | Mosbacher | 418/135 |
| 3,221,663 | 12/1965 | Schofield et al. | 418/206 |
| 3,474,736 | 11/1969 | Lauck | 418/131 |
| 3,528,756 | 9/1970 | Norlin et al. | 418/206 |
| 3,781,149 | 12/1973 | Weaver et al. | 418/206 |
| 4,087,216 | 5/1978 | Shumate | 418/131 |
| 4,355,964 | 11/1982 | Rodibaugh et al. | 418/206 |
| 4,781,541 | 11/1988 | Sohler et al. | 418/206 |

FOREIGN PATENT DOCUMENTS

| | | | |
|---|---|---|---|
| 3005656 | 8/1981 | Fed. Rep. of Germany | 418/206 |
| 1023137 | 6/1983 | U.S.S.R. | 418/206 |
| 1263910 | 11/1986 | U.S.S.R. | 418/206 |

*Primary Examiner*—Richard A. Bertsch
*Assistant Examiner*—David L. Cavanaugh
*Attorney, Agent, or Firm*—Dykema Gossett

[57] ABSTRACT

A gear pump which includes a pressure balancing structure to ensure balanced pressure within the pump chamber during low flow operation is disclosed. A groove is formed in the casing internal surface throughout the entire axial length of the gears and supplies high pressure fluid to positions within the pump chamber which are at a high pressure during normal flow operation. This groove thus ensures that high pressure fluid will be at all locations within the pump chamber which are expected to have high pressure during normal pumping operation. Forces on the gear are as expected during low flow operation, and that the gears will not be forced in an undesirable direction.

4 Claims, 2 Drawing Sheets

GEAR PUMP WITH PRESSURE BALANCING STRUCTURE

BACKGROUND OF THE INVENTION

The present invention relates to structure for providing balanced pressure to a gear pump during reduced flow operation.

Gear pumps are well known and utilized in many industrial applications. When used in hydraulic systems gear pumps may be operable to move fluid from a sump to a high pressure user system. These gear pumps may be constantly driven. When it is not desired to have the pump move fluid, some means of reducing the fluid moved by the constantly rotating gears is used. A valve typically restricts the inlet flow to the pump.

A known gear pump system is illustrated in FIG. 1. Gear pump 20 consists of a pair of gears 22 and 24 mounted within casing 26. Internal surface 28 is formed within casing 26 and defines a pump chamber to receive gears 22 and 24.

Sump 29 supplied fluid through inlet 30 into the pump chamber, and gears 22 and 24 rotate within the chamber to move fluid around their outer peripheries to outlet 32. Outlet 32 delivers the fluid through a pressure gage 34 and to a user system 36. A high pressure typically exists at outlet 32.

A force is applied to gears 22 and 24 from the high pressure fluid on the discharge side in a direction towards the inlet side. This force F directs the gears against the internal surface 28 of casing 26 in a direction generally perpendicular to the rotational axes of the gears and towards inlet 30. Due to force F, gears 22 and 24 contact internal surface 28 and material is removed from internal surface 28 until groove 38 is formed. Groove 38 is customized for the particular gears 22 and 24 and casing 26. The removal of material, or "tracking in" occurs during initial use of the gear pump and ensures a close fit between the tips of gear teeth 35 and internal surface 28. Internal surface 28 is quite hard, and as gears 22 and 24 remove material to form groove 38, the tips of gear teeth 35 may also be removed.

Contact line 33 is shown for gear 24. The spaces between adjacent gear teeth 35 past contact line 33, and towards outlet 32, contain high pressure fluid. Thus, there is high pressure fluid at positions between a center line 39 of casing 26 and contact line 33. Center line 39 could be defined as the intersection of a plane defined by the axes of gears 22 and 24, and internal surface 28. The high pressure fluid in the space between contact line 33 and center line 39 associated with gear 24 applies a force in a direction upwardly and to the right, as shown in FIG. 1. This force balances a force on the opposed side of gear 24 which is forcing it downwardly and to the left as shown in FIG. 1. Thus, the resultant force F on gear 24 is directly to the left as shown in FIG. 1, or in a direction towards inlet 30. Mirrored forces are applied to gear 22.

Inlet valve 40 is mounted on inlet 30 and can be actuated to restrict the flow of fluid from sump 29 into pump chamber 28. This would occur when it is not desired to have fluid delivered to system 36, but it is still desired to supply a small amount of fluid for bearing lubrication to rotating gears 22 and 24. This is known as "dry valve" operation. In such cases valve 40 is moved to the position illustrated in FIG. 2 and the flow into pump chamber 28 is restricted. At these low flow conditions a high vacuum is placed on inlet 30 which removes dissolved air from the fluid in the system. Air bubbles fill the spaces between adjacent gear teeth.

As shown in FIG. 2, the inter tooth space between center line 39 and contact line 33 now contains air rather than high pressure fluid. The air bubbles continue to rotate towards outlet 32 until they contact high pressure fluid, at which time they collapse. There is still high pressure fluid adjacent outlet 32, forcing gear 24 downwardly and to the left, but there is no longer high pressure fluid directing a force upwardly and to the right as shown in this figure. Thus the resultant force F is now downwardly and slightly to the left from the rotational axis of gear 24 and upwardly and slightly to the left from the rotational axis of gear 22. Gears 22 and 24 now move in these directions and new tracking grooves 42 are formed. The tips of gear teeth 35 experience additional wear tracking in groove 42.

When the pump returns to normal operation, there is no longer contact between gear teeth 35 and the casing at positions near contact line 33. The gear teeth tips have been removed such that there is undesirable clearance between gear teeth 35 and bore 28 near contact line 33, and perhaps throughout the entire circumferential extent of internal surface 28. This causes undesirable leaking.

Operating the gear pump under conditions such as extremely high vehicle attitude or low fluid levels could also result in the above-described problem. These conditions could result in a temporary uncovering of the inlet line in the fluid reservoir. When this occurs, large volumes of air could be introduced into the inlet causing a problem similar to the above-discussed problem.

Another problem that occurs when air is in the spaces between gear teeth is that pressure balanced side plates may be forced into the gears, such that the side plates could be torn or smeared. The side plates are typically forced against the gears by discharge pressure on a side remote of the pump chamber. This force is balanced by the pressure from the pump fluid within the pump chamber. In the absence of such pressure the side plates may be forced against the gear by an unbalanced force which could damage the side plates.

SUMMARY OF THE INVENTION

In a disclosed embodiment of the present invention, a groove is formed in the casing over the majority of the axial length of the gear at circumferential locations at least between the outlet and the center line of the casing. This groove ensures that high pressure fluid is directed into inter teeth spaces on the inlet side of the center line during any low flow operation. This high pressure fluid balances the forces from the high pressure fluid adjacent the outlet, and prevents the gears from being forced in an undesired direction. If the groove extended for less than the majority of axial length of the gears, sufficient fluid may not be supplied to balance the pressure. Further, the gears could bend along their length.

These and other objects and features of the present invention can be best understood from the following specification and drawings.

DETAILED DESCRIPTION OF A PREFERRED EMBODIMENT

Figure 3:
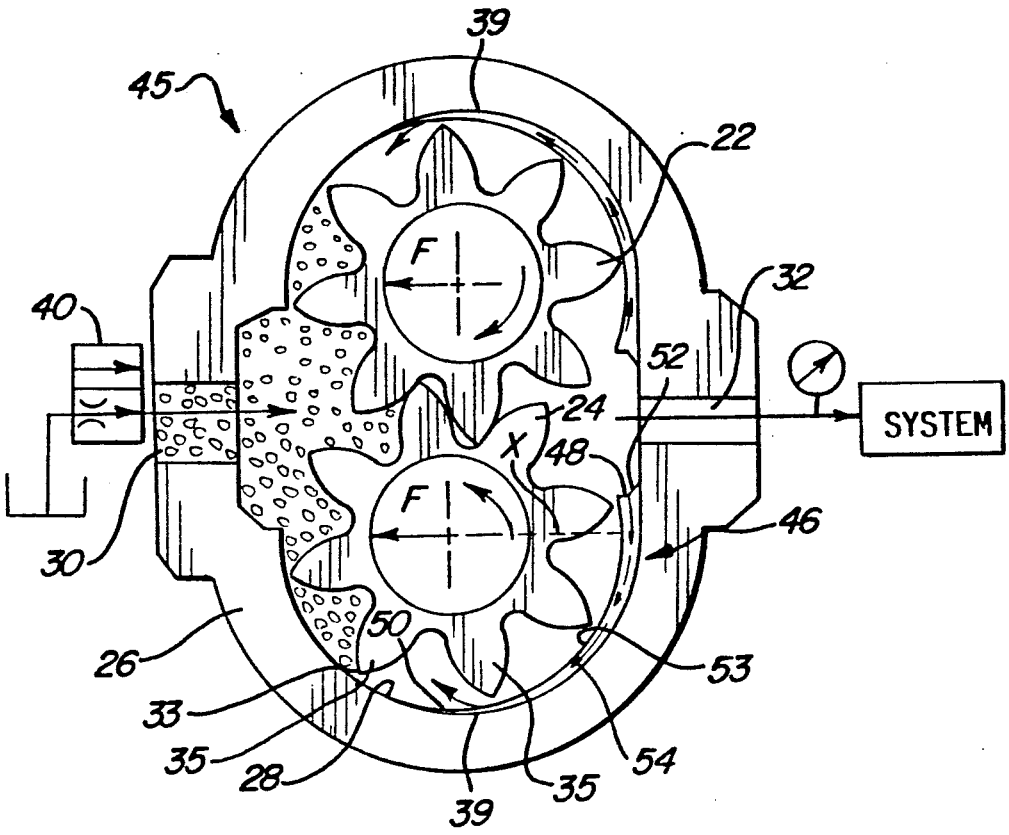
FIG. 3 is a cross-sectional view of gear pump according to the present invention.

Gear pump 45 as disclosed in the present application is illustrated in FIG. 3. Gear pump 45 includes groove 46 extending from a downstream location 48 to an upstream location 50. Downstream location 48 is slightly beyond a radius X drawn from the rotational axis of each of gears 22 and 24 perpendicular to a plane defined by the respective axes of gears 22 and 24, and in a direction towards outlet 32. Upstream end 50 is slightly beyond the 90° position on gears 22 and 24, measured from line X, and in a direction opposed to the direction of rotation of gears 22 and 24. The position of upstream end 50 is selected such that it remains downstream of contact line 33 during rotation of gears 22 and 24.

Figure 1:
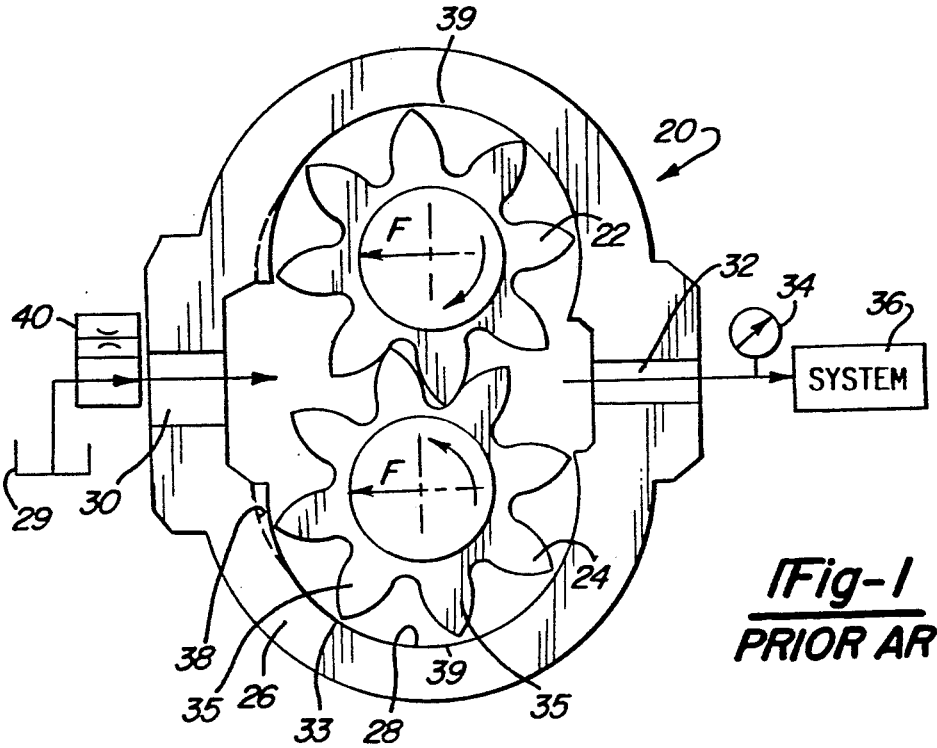
Fig-1 PRIOR ART
FIG. 1 is a cross-sectional view of a prior art gear pump under normal operation.
Figure 2:
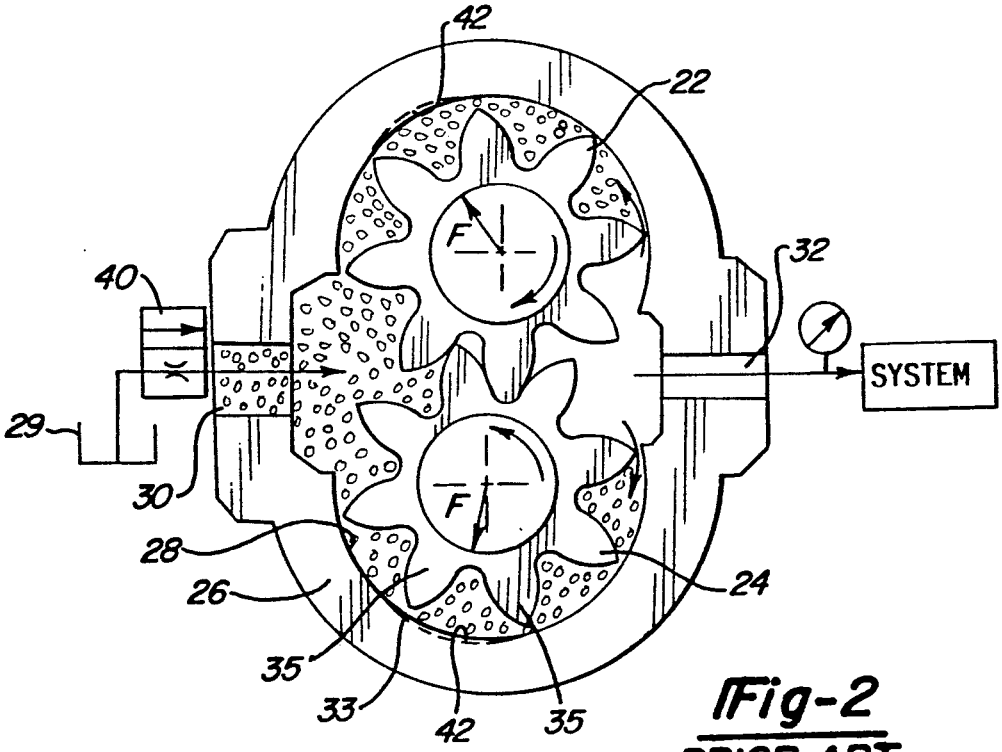
Fig-2 PRIOR ART
FIG. 2 is a cross-sectional view of a prior art gear pump during low flow operation.

As formed, casing 46 has a generally cylindrical inner periphery other than at groove 46. Groove 46 is formed in casing 26 through the entire axial length of gears 22 and 24. Ends 52 of casing 26 are formed at axial positions beyond gears 22 and 24. Ends 52 mount side pressure plates. Internal surface 28 of gear pump 45 includes a generally cylindrical portion for each gear 22 and 24. Ends 52 have an inner periphery 53 that is generally cylindrical, as do the portion of bores 28 which do not receive groove 46. A track similar to groove 38 may form with use, see FIG. 1, however, as manufactured bore 28 is generally cylindrical.

As shown, valve 40 is in a restricted flow position and air bubbles are found in the pump chamber adjacent to inlet 30. Groove 46 taps fluid from the pump chamber adjacent outlet 32 and into the inter tooth space adjacent upstream end 50. Thus, pressurized fluid is in the inter tooth space towards the inlet, past casing center line 39. The forces on gears 22 and 24 are properly directed or controlled. As shown, force F is perpendicular to the plane defined by the rotational axes of gears 22 and 24 and in a direction towards inlet 30. Gears 22 and 24 form a "track in" groove 38 as disclosed with reference to FIG. 1.

Groove 46 has a first depth adjacent downstream end 48 and remains relatively constant to a location 54 approximately 45° from the above radius X. After location 54 the groove depth begins to trail away to smaller dimensions until it finally ends at upstream end 50. In one embodiment of gear pump 45, the gear diameter was 2.54 inches, the gear was 2.27 inches in axial length, and the groove depth at upstream end 48 was 0.10 inches. Groove 46 tapered to 0 inches at upstream point 50.

Figure 4:
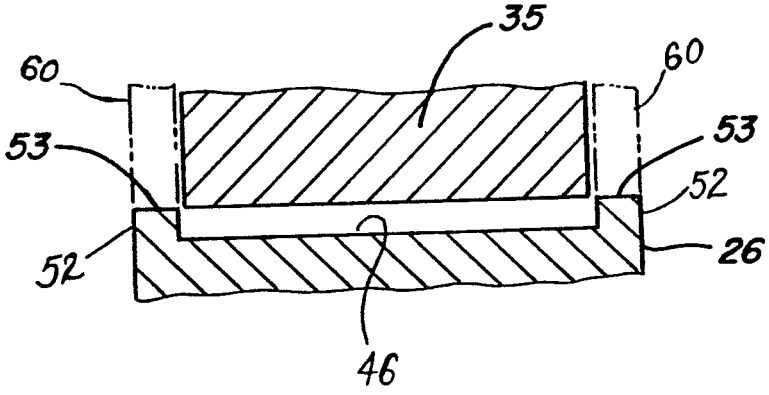
FIG. 4 is a cross-sectional view along line 4—4 as shown in FIG. 3.

FIG. 4 shows groove 46 extending for the entire axial length of gear 35. As shown, ends 52 have inner peripheral surfaces 53 which support pressure plates 60, shown in phantom, to define an enclosed pump chamber.

Casing 26 is formed as a casting with a cylindrical bore including end 52. Groove 46 is machined into the bore during final machining.

A preferred embodiment of the present invention has been disclosed, however, a person of ordinary skill in the art would recognize that certain modifications would come within the scope of this invention. For that reason, the following claims should be studied in order to determine the true scope and content of this invention.

I claim:

1. A gear pump comprising:

a casing having an internal surface defining a pump chamber, said pump chamber being formed of two pump chamber halves, each of said pump chamber halves defined by generally cylindrical surface portions on said internal surface centered about respective axes at a radial distance;

a pair of gears, with one of said gears being mounted in each of said pump chamber halves, said gears being rotatable about said respective axes, said gears having gear teeth at their outer peripheries and said gear teeth of said respective gears meshing at locations between said axes;

an inlet extending into said pump chamber on one side of a plane defined by said axes, an outlet extending out of said pump chamber on the opposed side of said plane, said plane intersecting said casing to define center lines, said pump chamber halves being configured such that said internal surface is non-cylindrical having a groove at a distance away from said axes greater than said radial distance in a region beginning near said center line and slightly toward said inlet, and moving in a direction towards said outlet, said grooves extending over at least half of the axial length of said gears to define a clearance; and said internal surfaces both extend inwardly from said grooves at positions axially beyond each end of said gears, and define support surface approximately at said radial distance from said axes.

2. A gear pump as recited in claim 1, wherein said clearance having a downstream end spaced further from said axes than a nominal inner periphery of said pump chamber by a first distance and said gears having a diameter, the ratio of said first distance to said gear diameter being less than 1:20.

3. A gear pump as recited in claim 2, wherein said groove extends for the entire axial length of said gears.

4. A gear pump as recited in claim 1, wherein side pressure plates are supported on said support surface at said positions axially beyond each end of said gears.

* * * * *